US005909712A

United States Patent [19]

Tan

[11] Patent Number: 5,909,712

[45] Date of Patent: Jun. 8, 1999

[54] STRUCTURE OF PAPER PALLET

[76] Inventor: Ya-Te Tan, No. 9, Sublane 1, Lane 434, Hu Shan St., Kuei Shan Hsiang, Taoyuan Hsien, Taiwan

[21] Appl. No.: 09/110,481

[22] Filed: Jul. 7, 1998

[51] Int. Cl.[6] ..... B65D 19/00

[52] U.S. Cl. ..... 108/51.3

[58] Field of Search ..... 108/51.3, 51.1

[56] References Cited

U.S. PATENT DOCUMENTS

| | | | |
|---|---|---|---|
| 5,184,558 | 2/1993 | Wozniacki | 108/51.3 |
| 5,383,409 | 1/1995 | Hayakawa | 108/51.3 |
| 5,385,103 | 1/1995 | Juvik-Woods | 108/51.3 |
| 5,427,019 | 6/1995 | Moorman | 108/51.3 |
| 5,463,965 | 11/1995 | Cordrey | 108/51.3 |
| 5,465,672 | 11/1995 | Boyse et al. | 108/51.3 |
| 5,517,926 | 5/1996 | Young, Jr. | 108/51.3 |
| 5,694,863 | 12/1997 | Chen | 108/51.3 |

FOREIGN PATENT DOCUMENTS

| | | | |
|---|---|---|---|
| 1340328 | 12/1973 | United Kingdom | 108/51.3 |

*Primary Examiner*—Jose V. Chen
*Attorney, Agent, or Firm*—Rosenberg, Klein & Bilker

[57] ABSTRACT

An improved structure of a paper pallet includes a generally inverted U-shaped portion, a generally E-shaped portion, and two rectangular portions all cut out from a rectangular paper blank. A plurality of the inverted U-shaped portions and the E-shaped portions are respectively stacked and adhered together to form upper and lower structural bodies of a suitable thickness. The lower structural bodies are spaced apart in a row, and the upper structural bodies are spacedly straddled on the lower structural bodies and adhered thereto to thereby form a paper pallet with insert slots on each side thereof.

2 Claims, 8 Drawing Sheets

STRUCTURE OF PAPER PALLET

BACKGROUND OF THE INVENTION (a) Field of the Invention

The present invention relates to an improved structure of a paper pallet, and more particularly to a paper pallet structure that enhances material use efficiency and has high supporting strength.

(b) Description of the Prior Art

Pallets are indispensable in manufacturing industries. The are used to support goods to be lifted by lifters and transported by containers. Conventional pallets are mostly made from wood. However, with the depletion of forests and following the trend of environmental conservation, it is getting more and more difficult to obtain timber or wood material. Therefore, paper pallets have been developed to take the place of wooden pallets.

FIG. 1 shows a paper pallet 1 of the conventional type. The paper pallet 1 is formed by a plurality of vertical supporting pieces 11 pressed and adhered together. Opposed insertion slots 12 are formed on the periphery by hollowing to facilitate insertion of forks F of a lifter for lifting purposes. Since the pallet 1 is formed by stacking multiple layers of corrugated paper. When the direction of insertion of the forks F is parallel to the adhered surfaces of the supporting pieces 11, the adhered surfaces of the supporting pieces 11 at the junction between the forks F and the pallet 1 will result in concentration of shearing stress. If the goods supported on the pallet 1 are excessively heavy, the structure of the pallet 1 will be damaged. More corrugated paper is therefore needed to form the pallet 1 in order to increase its structural strength. Besides, hollowing out the peripheral portion of the pallet 1 to form insertion lots 12 will produce more waste material.

FIG. 2 shows another structure of the conventional paper pallet. A paper pallet 2 includes planar supporting plate 21 and base plates 22 formed by stacking and adhering multiple layers of corrugated paper. Paper posts 23 arranged in a row are adhered to the supporting plate 21 above and the base plates 22 below. Since the area of adhesive contact among the supporting plate 21, the base plates 22, and the paper posts 23 is small, they may easily come apart. This type of paper pallet not only is inferior in structural strength but also unable to resist water or dampness. Furthermore, since the supporting plate 21 is formed by large-area corrugated paper adhered together and since recycled pallets are usually not intact, new corrugated paper is needed to form this type of paper pallet, which is not environmental friendly.

SUMMARY OF THE INVENTION

A primary object of the present invention is to provide an improved structure of a paper pallet that enhances material use efficiency and that has high supporting strength.

In order to achieve the above-mentioned object, an improved structure of a paper pallet includes a generally inverted U-shaped portion, a generally E-shaped portion, and two rectangular portions all cut out from a rectangular paper blank. A plurality of the inverted U-shaped portions and the E-shaped portions are respectively stacked and adhered together to form upper and lower structural bodies of a suitable thickness. The lower structural bodies are spaced apart in a row, and the upper structural bodies are spacedly straddled on the lower structural bodies and adhered thereto to thereby form a paper pallet with insert slots on each side thereof.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
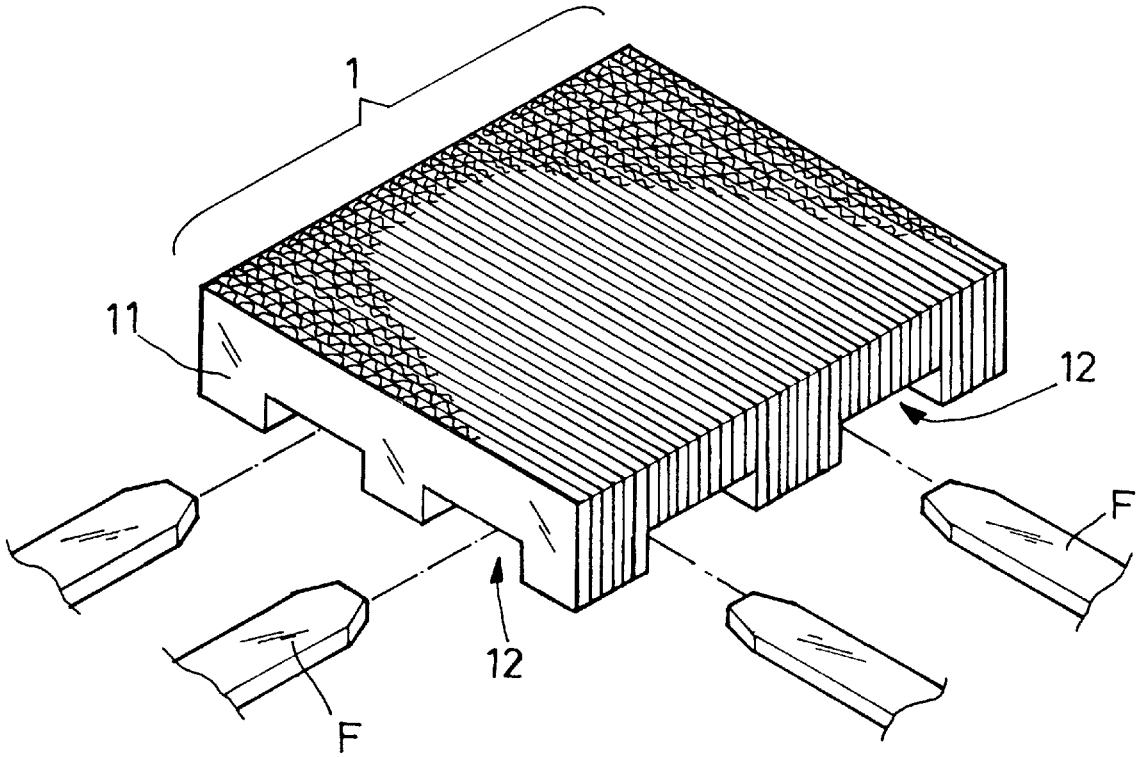
PRIOR ART FIG. 1
FIG. 1 is a perspective view of one type of conventional paper pallet which is formed by multiple layers of corrugated paper adhered together.
Figure 2:
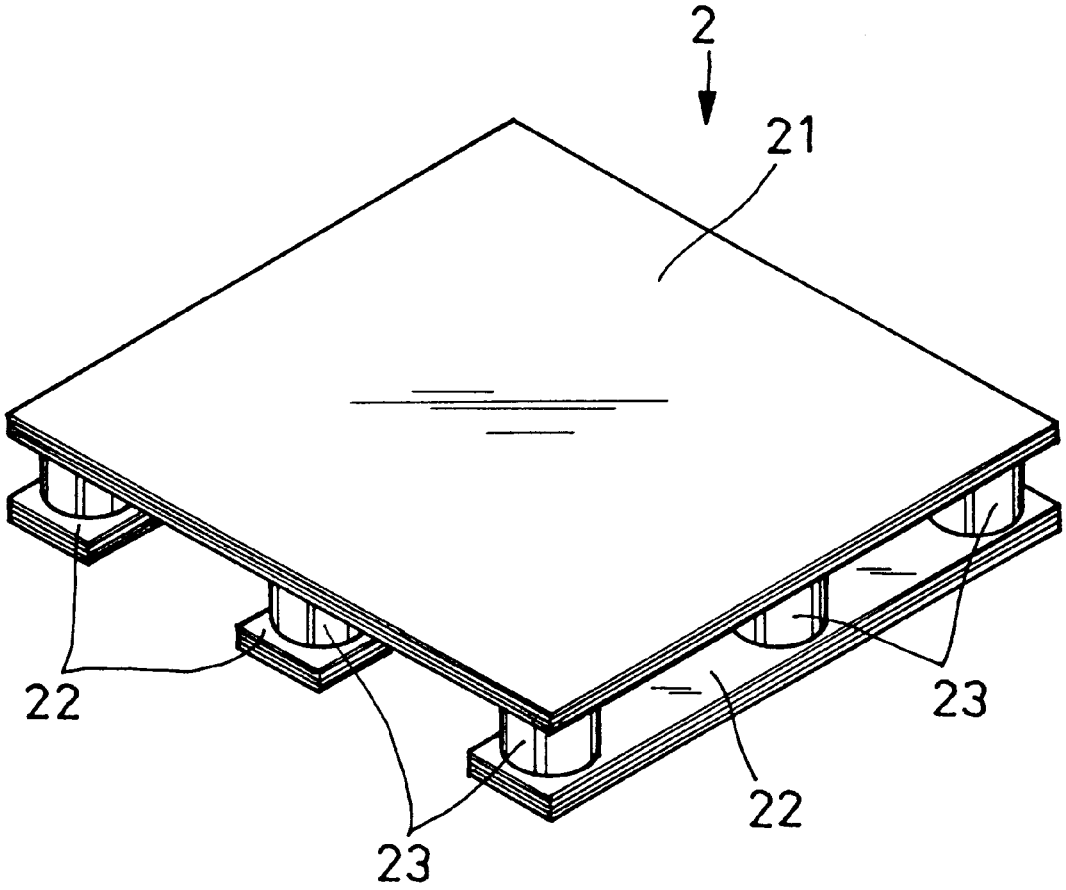
PRIOR ART FIG. 2
FIG. 2 is a perspective view of another type of conventional paper pallet which utilizes paper posts to connect a supporting plate and base plates.
Figure 3:
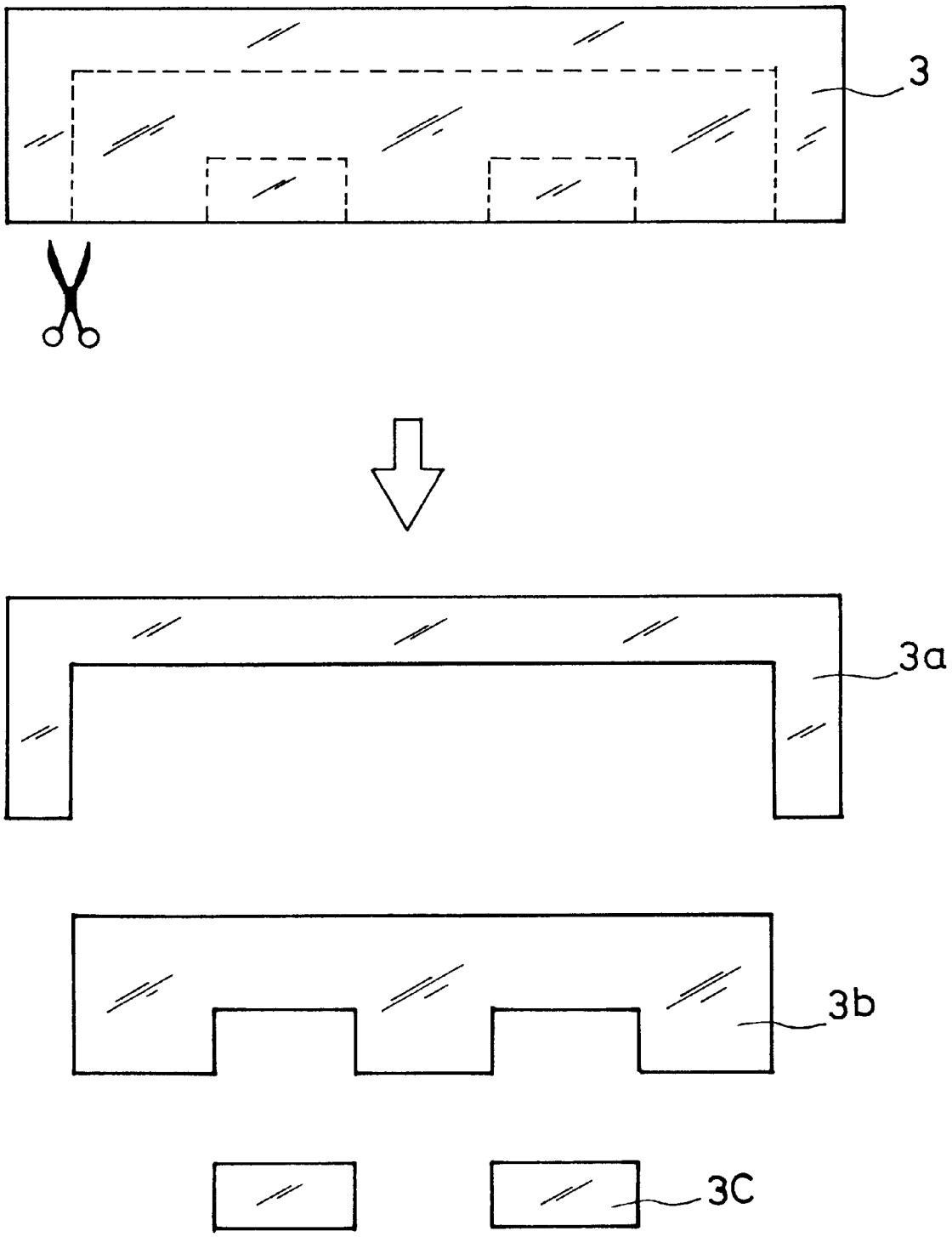
FIG. 3 is a schematic view illustrating the way of cutting a blank material of the present invention.

Reference is first made to FIG. 3. A rectangular paper blank 3 is cut along its one longer side and two shorter sides to form a substantially inverted U-shaped portion 3*a;* the remaining portion is cut along its longer side to form a substantially E-shaped portion 3*b* with a pair of insert slots 41, and two rectangular portions 3*c*.

Figure 4:
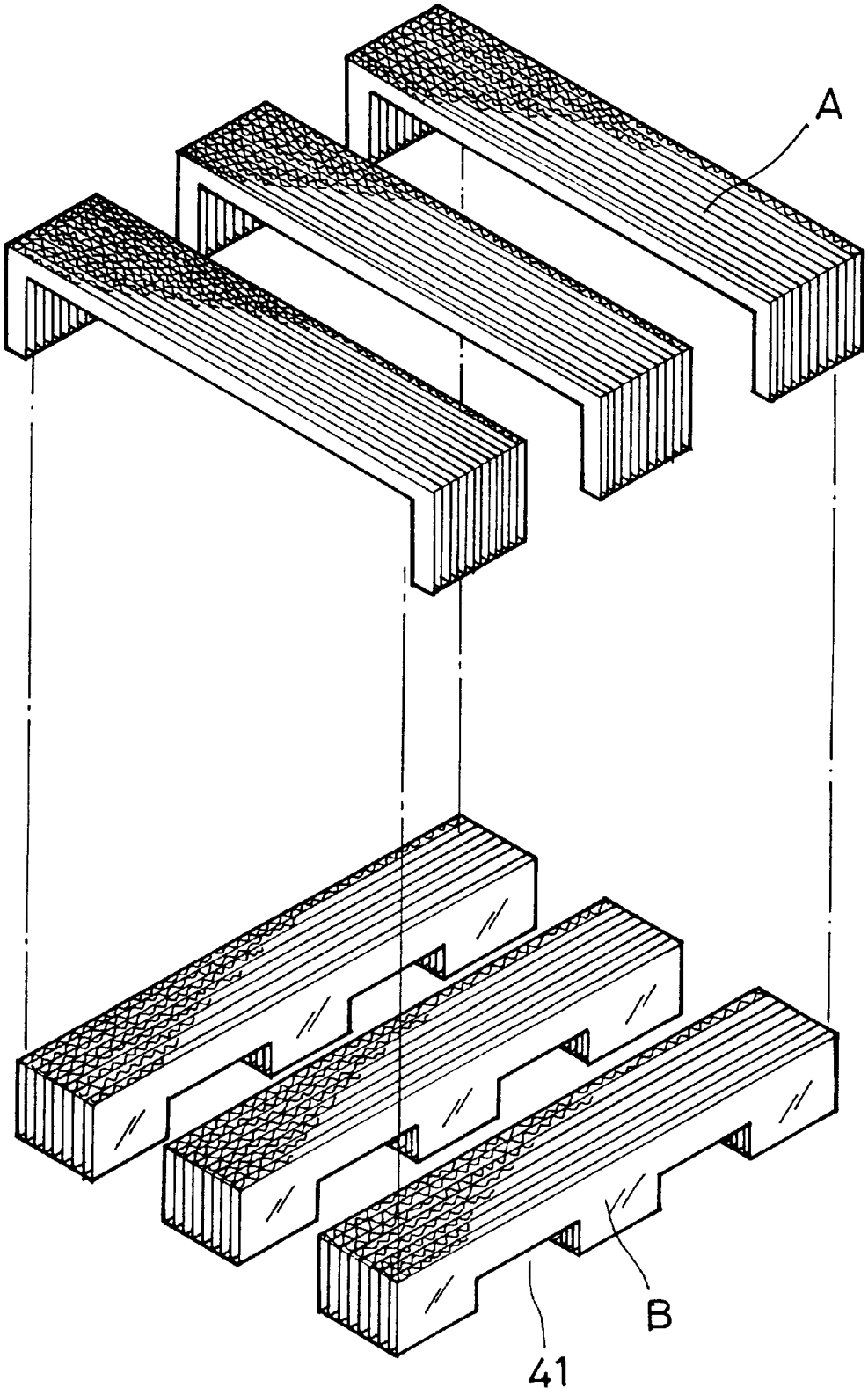
FIG. 4 is an exploded view of the structural of a preferred embodiment of the present invention.
Figure 5:
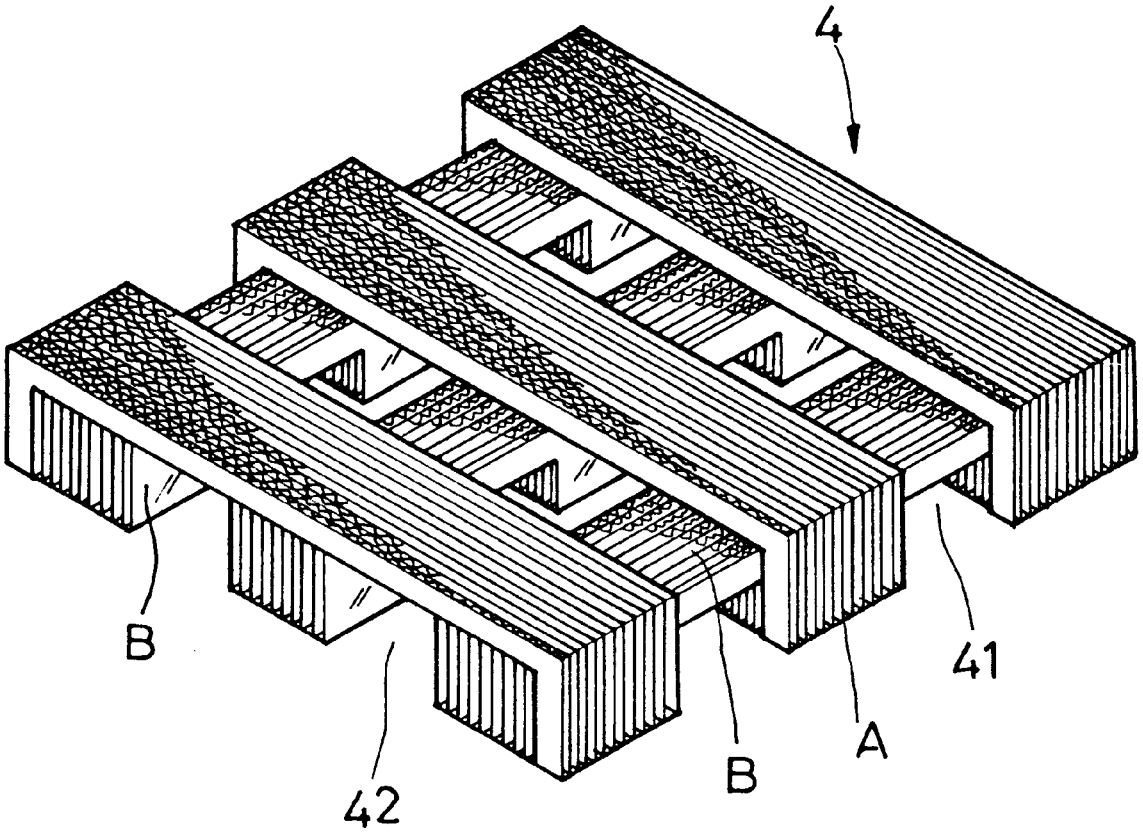
FIG. 5 is a perspective view of the structure of the preferred embodiment of the present invention.

In FIG. 4, it is shown that inverted U-shaped portions 3*a* and the E-shaped portions 3*b* are respectively stacked and adhered to form upper structural bodies A and lower structural bodies B of a suitable thickness. Referring to FIG. 5, three lower structural bodies B are spaced a suitable distance apart in a row to form a pair of insertion slots 42 along a longitudinal direction of the lower structural bodies B. Three structural bodies A are also spaced suitably apart and vertically straddled on top of the row of lower structural bodies B and adhered thereto, forming a paper pallet 4 having insertion slots on all sides thereof. The paper pallet 4 thus formed can provide a larger area for supporting goods.

Figure 6:
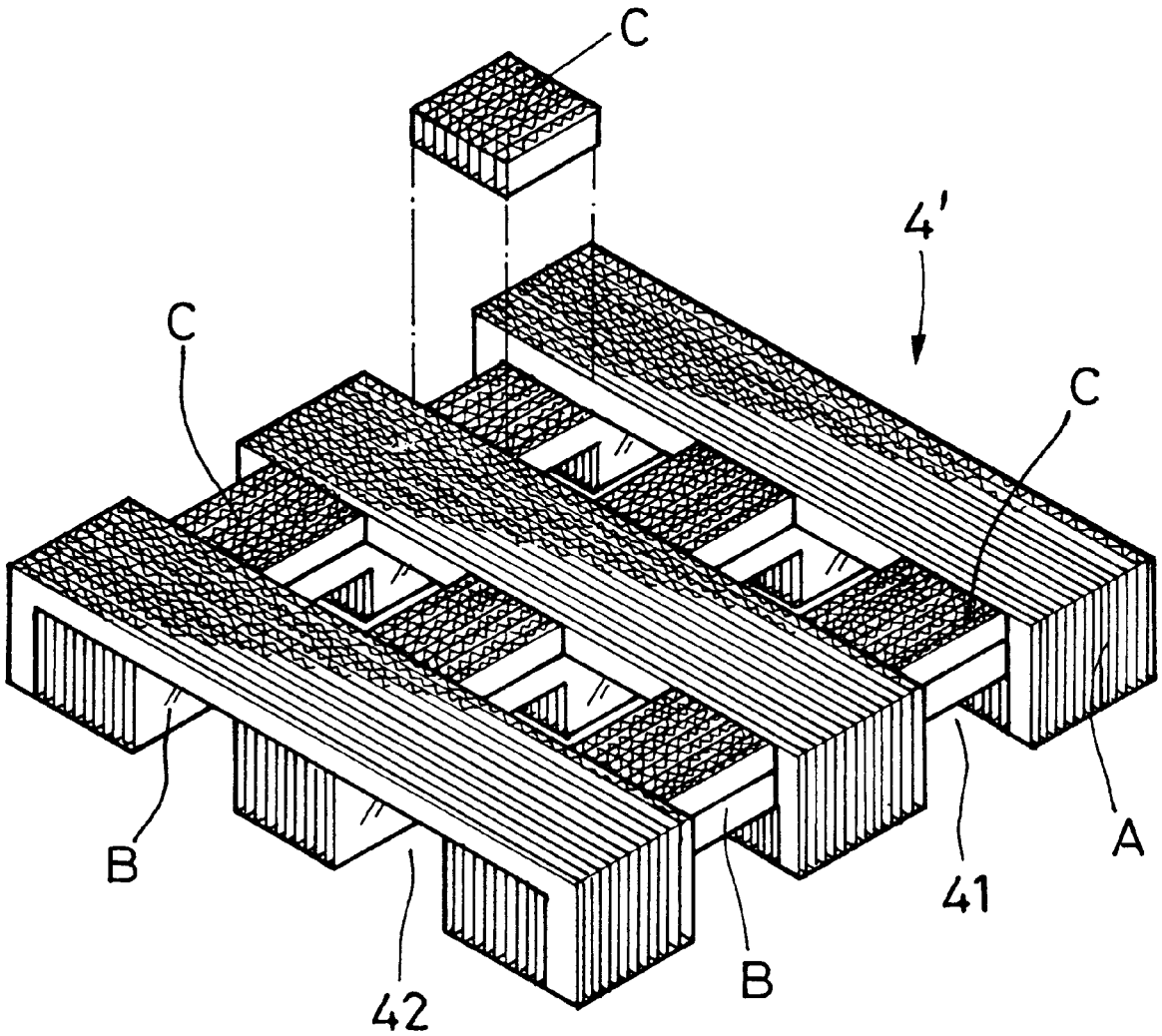
FIG. 6 is a perspective view of the structure of another preferred embodiment of the present invention.

Referring to FIG. 6, the rectangular portions 3*c* are stacked and adhered to form reinforcing bodies C having the same thickness as the lower structural bodies B. The reinforcing bodies C are then adhered onto those portions of the E-shaped portions 3*b* exposed between the spaced inverted U-shaped portions 3*a* to form a paper pallet 4' of a planar supporting surface. In this way, the surface of the paper pallet 4' is a planar and can support large and small size goods.

According to the present invention, a rectangular paper blank 3 can be cut into an inverted U-shaped portion 3*a,* an E-shaped portion 3*b,* and two rectangular portions 3*c,* and such inverted U-shaped portions 3*a,* E-shaped portions 3*b,* and rectangular portions 3*c* are respectively stacked and adhered together to form upper and lower structural bodies A, B, and reinforcing bodies C, which are assembled to form a paper pallet 4 or 4'. In this way, all parts of the paper blank 3 can be used, without creating any waste material.

Furthermore, in the present invention, since the three lower structural bodies B are spaced suitably apart in a row to form a pair of insertion slots 42, and the three upper structural bodies A are also spaced suitably apart and straddled on the lower structural bodies B to adhere to the latter. Such a criss-cross overlapping design saves material yet maintaining a suitable supporting strength. When the forks F of a lifter is inserted into the insertion slots 41 cut from the lower structural bodies B, the forks F are substantially perpendicular to the adhering surface of the lower structural bodies B. Further, when the forks F are inserted into the insert slots 43 formed when the lower structural bodies B are spaced apart in a row, the forks F are substantially perpendicular to the adhering surface of the upper structural bodies A. Therefore, the forks F can be inserted from any side of the paper pallet without creating stress concentration. Hence, the present invention not only saves material and has high supporting strength but also enhances use efficiency of unit volume material.

Figure 7:
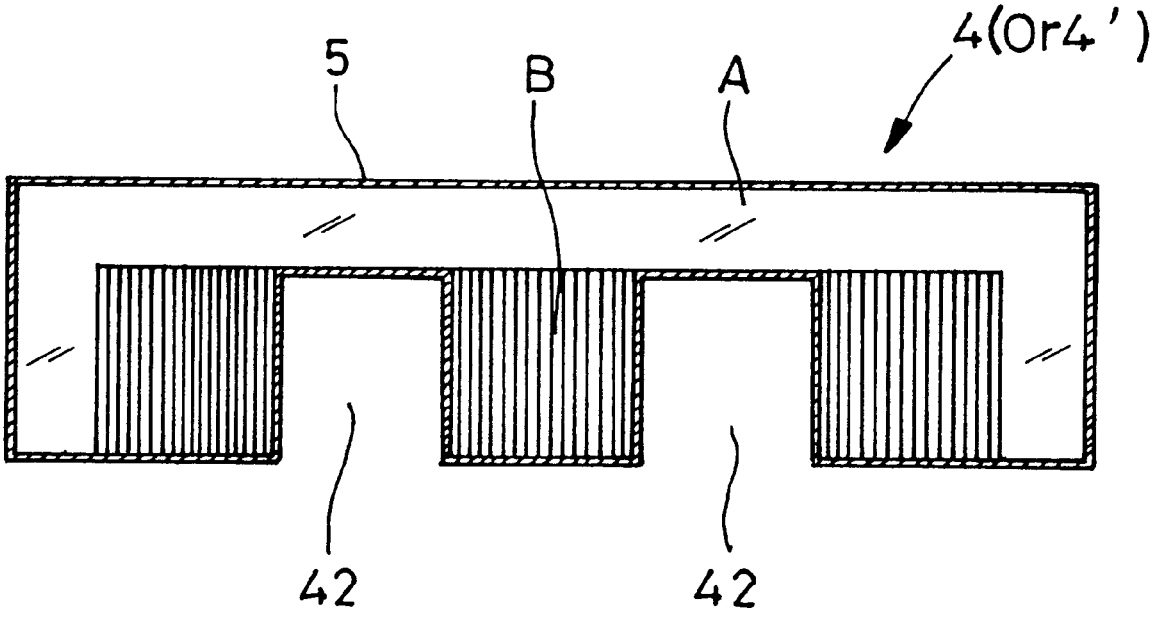
FIG. 7 a schematic view of the present invention wrapped in a plastic film.

Referring to FIG. 7, the paper pallet 4 or 4' can further be wrapped in a plastic film 5 by using skin packaging so that it is water and dampness resistance.

Figure 8:
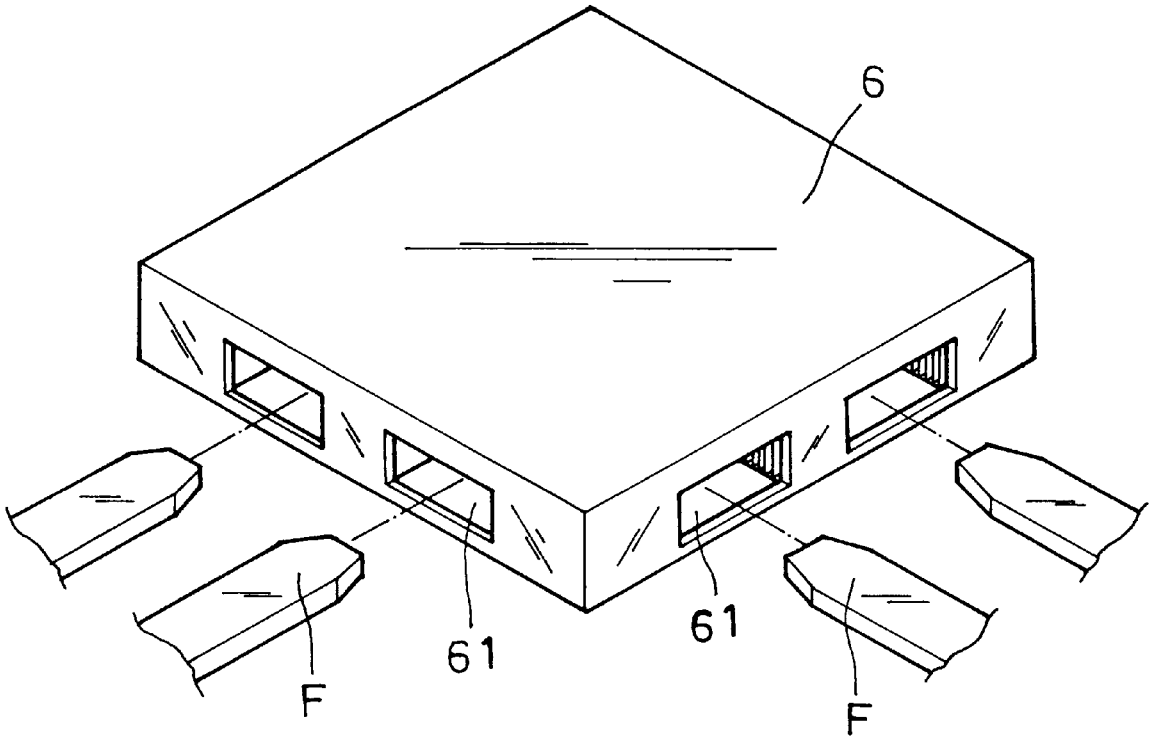
FIG. 8 is a perspective view of the present invention wrapped in paper.

Referring to FIG. 8, the paper pallet 4 or 4' can also be wrapped in a sheet of dampness-proof paper 6, which is provided with insert holes 61 corresponding to the insert holes 41, 42 of the paper pallet 4 or 4'. In this way, the paper pallet is not only dampness resistant, its outer appearance is also intact and appealing. Users can determine the number of plastic films or sheets of paper 6 based on their actual needs.

In summary, the present invention not only reduce use of material, it can also be made from small-size paper. Besides, the criss-cross overlapping structures provide high supporting strength. The paper pallet of the present invention can also be made water and dampness resistant.

Although the present invention has been illustrated and described with reference to the preferred embodiment thereof, it should be understood that it is in no way limited to the details of such embodiment but is capable of numerous modifications within the scope of the appended claims.

What is claimed is:

1. A paper pallet, comprising:

a plurality of E-shaped lower structural bodies being laterally spaced in a row, adjacent pairs of said lower structural bodies being spaced one from the other by a first dimension, said first dimension being sufficient to receive a fork truck's fork between said adjacent pairs of said lower structural bodies, each of said lower structural bodies having a longitudinally extended portion disposed horizontally and three transversely directed portions extending vertically downward to a base surface, each of said three transversely directed portions being spaced from an adjacent other transversely directed portion by a second dimension, said second dimension being sufficient to receive a fork truck's fork between said transversely directed portions, each of said lower structural bodies being formed by a plurality of stacked E-shaped blanks adhesively joined together to form a predetermined thickness for said lower structural body;

a plurality of U-shaped upper structural bodies spaced longitudinally by said second dimension and respectively adhered to said plurality of E-shaped lower structural bodies, each of said U-shaped upper structural bodies extending laterally across said plurality of E-shaped lower structural bodies in alignment with a respective one of said transversely directed portions of each of said plurality of E-shaped lower structural bodies and extending a predetermined height thereabove, each of said U-shaped upper structural bodies being formed by a plurality of stacked U-shaped blanks adhesively joined together to form a predetermined thickness for said upper structural body; and, a plurality of reinforcing bodies adhered between respective pairs of said U-shaped upper structural bodies, each of said plurality of reinforcing bodies being disposed in overlaying relationship with a section of said longitudinally extended portion of a respective one of said plurality of E-shaped lower structural bodies, each of said plurality of reinforcing bodies being formed by a plurality of stacked rectangular blanks adhesively joined together and having a height dimension equivalent to said predetermined height of said upper structural bodies to form a planar surface therewith.

2. The paper pallet as recited in claim 1 further comprising an outer wrap overlaying said plurality of E-shaped lower structural bodies, said plurality of U-shaped upper structural bodies, and said plurality of reinforcing bodies for providing moisture resistance thereto.

* * * * *